United States Patent [19]

Walter

[11] 4,273,026

[45] Jun. 16, 1981

[54] GUN ALIGNMENT ADJUSTING DEVICE

[75] Inventor: Albert F. Walter, Fort Worth, Tex.

[73] Assignee: The United States of America as represented by the Secretary of the Air Force, Washington, D.C.

[21] Appl. No.: 63,499

[22] Filed: Aug. 3, 1979

[51] Int. Cl.[3] ..... F41F 19/00

[52] U.S. Cl. ..... 89/37 R; 89/37.5 C

[58] Field of Search ..... 89/37 R, 37 B, 37 E, 89/37 K, 37.5 C, 41 A

[56] References Cited

U.S. PATENT DOCUMENTS

| | | | |
|---|---|---|---|
| 1,939,540 | 12/1933 | Charvet . | |
| 2,143,167 | 1/1939 | Pechar . | |
| 2,424,011 | 7/1947 | De Gramont | 248/178 |
| 2,436,948 | 3/1948 | Williams . | |
| 2,911,723 | 11/1959 | Ashbrook . | |
| 2,949,825 | 8/1960 | Musser et al. | 89/41 A |
| 3,353,291 | 11/1967 | Musser et al. | 89/41 A |
| 3,550,300 | 12/1970 | Roder | 89/41 A |

*Primary Examiner*—Stephen C. Bentley

*Attorney, Agent, or Firm*—Donald J. Singer; Arsen Tashjian

[57] ABSTRACT

A device for mechanically adjusting a gun with respect to a separate sighting means. The gun has a gimbal mounting and a double eccentric mounting arrangement, whereby the gun can be adjusted or aligned to a specific relationship with the sight, and once adjusted, can be locked to maintain such adjusted position.

8 Claims, 9 Drawing Figures

FIG. 1
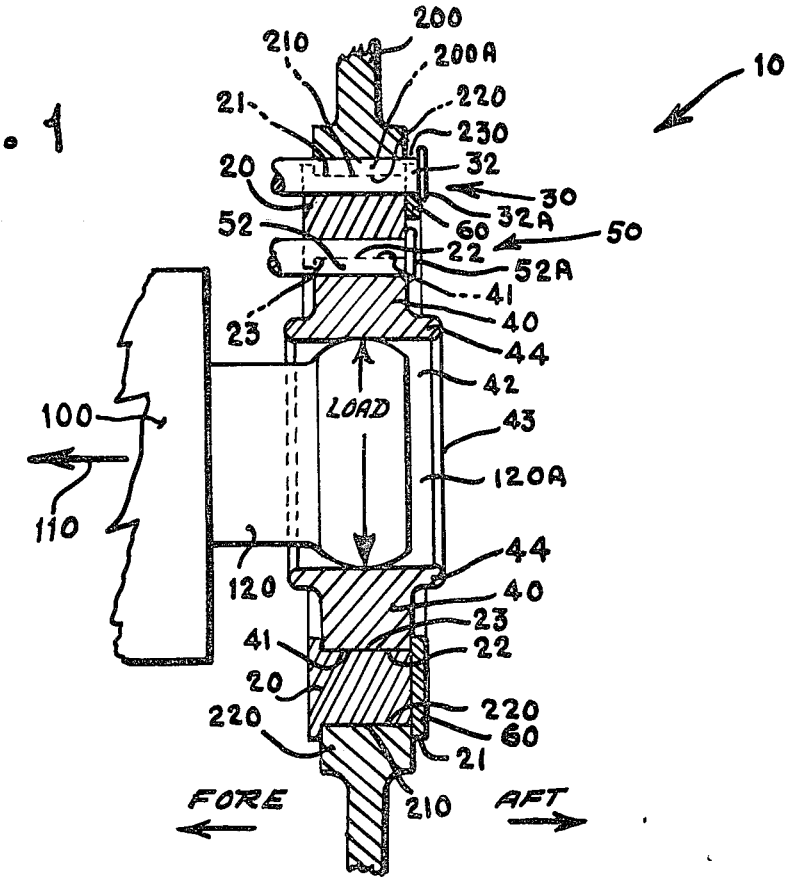
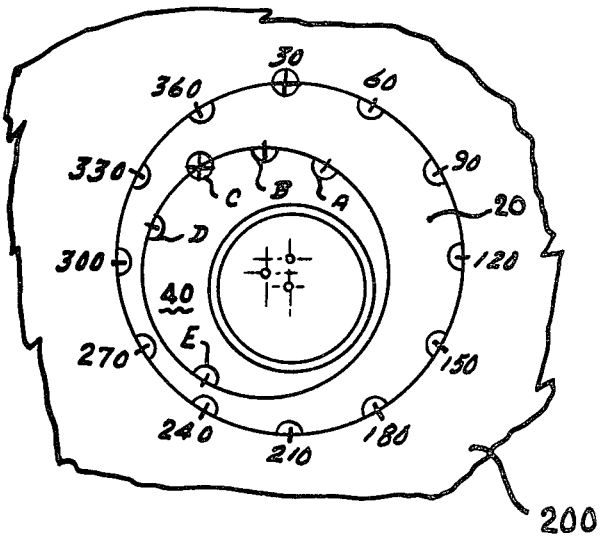
FIG. 5
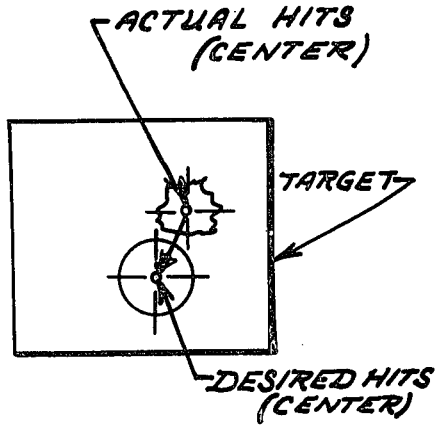
FIG. 6

FIG. 7
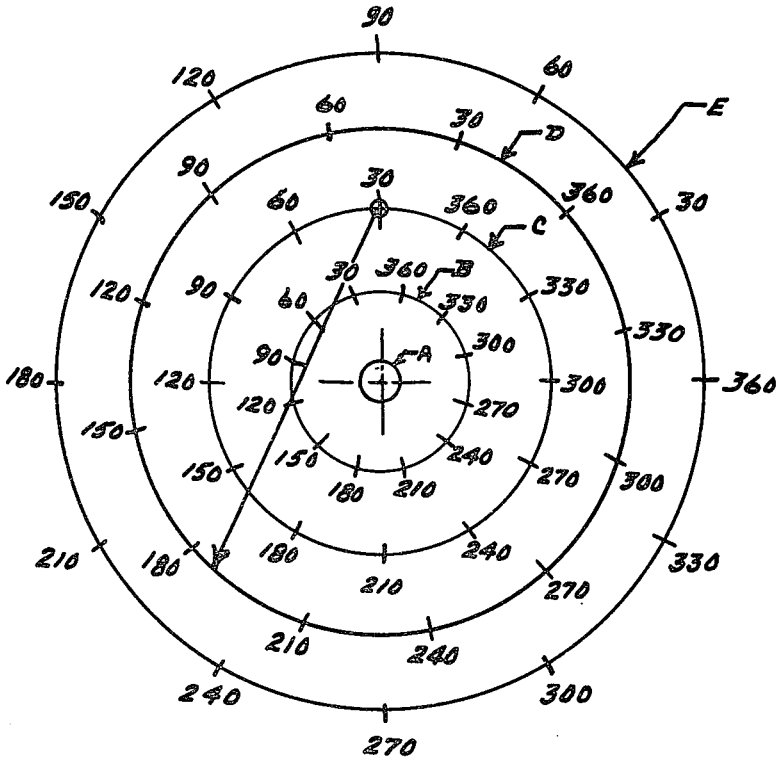
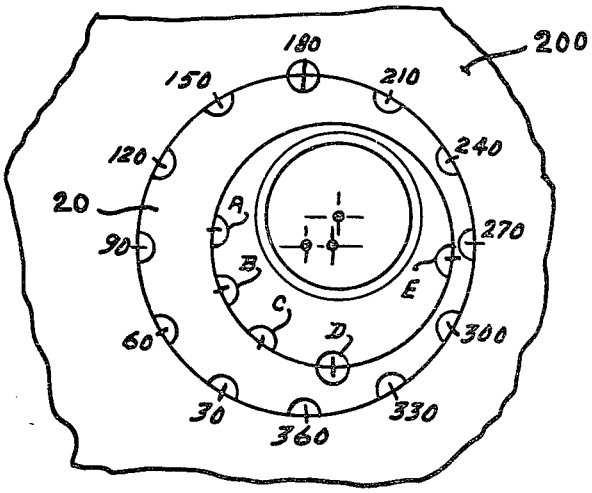
FIG. 8
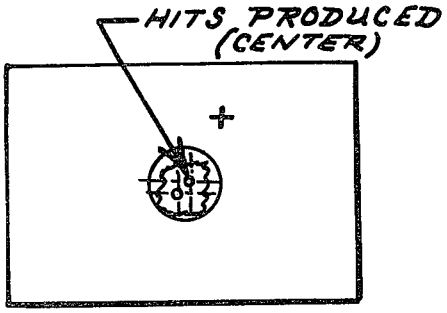
FIG. 9

GUN ALIGNMENT ADJUSTING DEVICE

STATEMENT OF GOVERNMENT INTEREST

The invention described herein may be manufactured and used by or for the Government for governmental purposes without the payment of any royalty thereon.

BACKGROUND OF THE INVENTION

This invention relates to a gun alignment adjusting device (hereinafter referred to as GAAD) and, more particularly, to a unique GAAD which provides capability to move (i.e., adjust) a gun between any two alignments available, within the constructed limits of the GAAD, by a single two-stage operation and also positively retains the adjusted position under all operating conditions.

Installations which incorporate "fixed" guns, aimed by "fixed" but offset-mounted sighting systems, required a means to align the gun to a specific relationship with the sight. This capability can be provided by "gimbal-mounting" the gun, and supplying a means to impart controlled movement to the gun in appropriate arcs about the gimbal (i.e., a GAAD). After the required motion is accomplished, the device should remain as set, until further gun line adjustment is desired or required.

Prior art GAADs use a system of jack screws and a sliding block, and have inherent disadvantages. Some of the more important of these disadvantages are: inefficient use of space; greater weight and cost; requiring more weight in the supporting structure to accommodate stresses due to eccentricity between load and reaction points; susceptibility to disturbances from effects of gunfiring, thus loss of gun alignment; requiring frequent maintenance to cope with the aforesaid loss of gun alignment; and, requiring heavy and measured torque inputs to check the security of threaded members and to unlock and relock said members during the adjusting operation. My GAAD is superior to prior art GAADs, because it is more compact, lighter in weight, less costly to produce, more efficient in operation, and requires no maintenance during the expected long life of its parts.

By the invention of my GAAD I have significantly advanced the state-of-the-art.

SUMMARY OF THE INVENTION

My inventive GAAD is for use in combination with a gun having an alignment and an aft support, and with a stationary support structure that is adjacent to and aft of the aft support of the gun. Additionally, my GAAD is simple, compact, low in cost, durable, and maintenance-free. Further, it provides capability to move (i.e., adjust) the gun between any two alignments available, within its constructed structural limitations, by a single two-stage operation, and still positively retains the adjusted position under all operating conditions.

Accordingly, the principal object of this invention is to teach the structure of a preferred embodiment of my above-described unique GAAD.

This principal object, as well as other related objects, of this invention will become readily apparent after a consideration of the description of the invention, together with reference to the Figures of the drawings, in which the same reference character refers to the same component (or the like) of the invention.

DESCRIPTION OF THE DRAWINGS

FIG. 1 is a side elevation view, in simplified form, both schematic and pictorial, partially in cross section and partially fragmented of the preferred embodiment of my inventive GAAD, as used in combination with a gun and a stationary support structure;

DESCRIPTION OF THE PREFERRED EMBODIMENT

Figure 2:
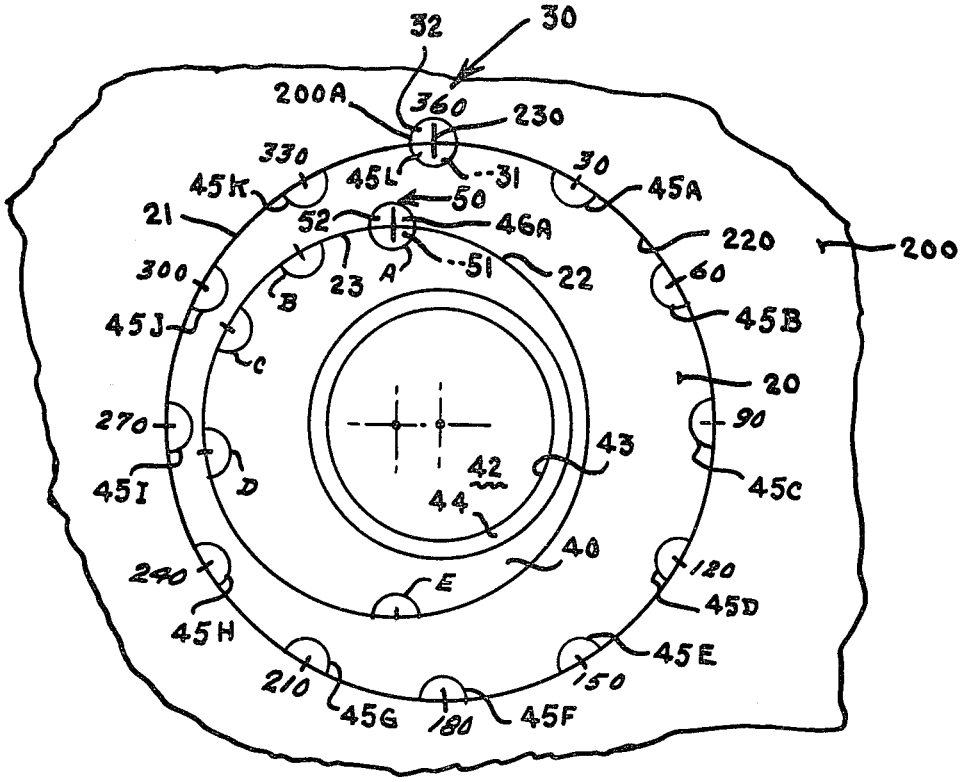
FIG. 2 is a view of the inventive GAAD, as rotatably mounted in the stationary support structure, with the hub centered, and as viewed forwardly from the aft end of the gun.

As a preliminary matter, it is to be remembered that my invention GAAD is for use in combination with a gun having an alignment and an aft support, and with a stationary support structure that is adjacent to and aft of the aft support of the gun.

Accordingly, with reference to FIG. 1, therein is shown the preferred embodiment 10 of my GAAD that is in combination with the gun 100 which has an alignment 110 and an aft support 120, and that is also in combination with the stationery support structure 200 which is adjacent to and aft of the aft support 120 of the gun 100. More specifically, the stationary support structure 200 has an opening 210 therein and therethrough that is in alignment with, and sized larger than, the aft support 120 of the gun 100, and that has a perimeter 220 formed by the opening 210. The support structure 200 also has an index marking 230 at a preselected fixed location adjacent its opening 210 and the perimeter 220.

Figure 3:
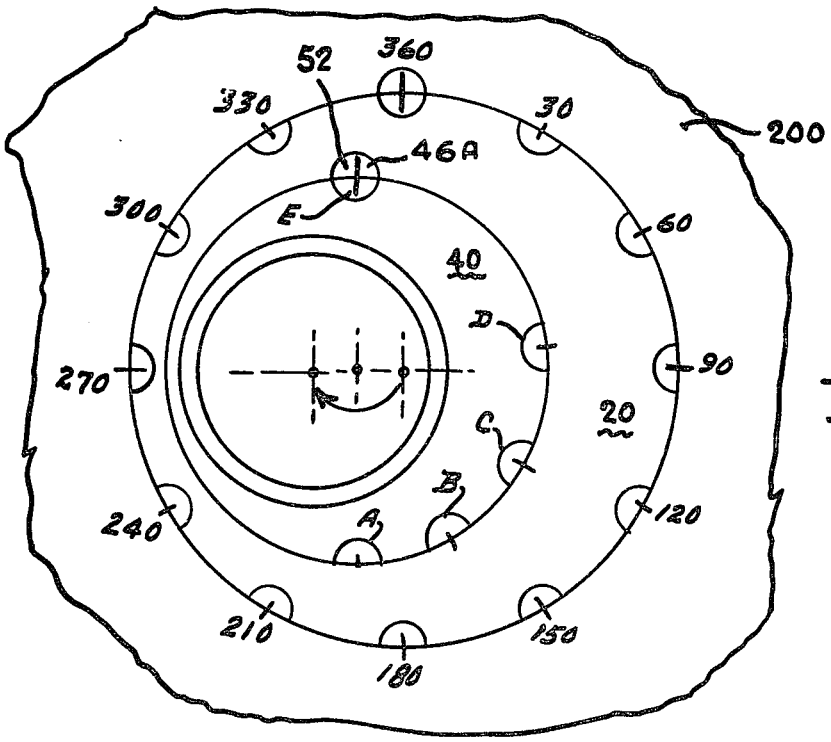
FIG. 3 is a view similar to the one shown in FIG. 2, with the hub at maximum displacement.

With reference to FIGS. 1–3, inclusive, my GAAD 10 comprises, in its generic structural form: an outer eccentric member 20 that is rotatably mounted in the opening 210 in the stationary support structure 200, wherein the outer eccentric member 20 has an outer perimeter 21, and an off-center opening 22 that is sized larger than the aft support 120 of the gun 100 and that forms an inner perimeter 23 and wherein the outer eccentric member 20 also has an index marking at a preselected location adjacent its opening 22 and the perimeter 23; means generally designated 30, for releasably locking, in a preselected rotational relationship, the outer eccentric member 20 to the stationary support structure 200; and inner eccentric member 40 that is rotatably mounted in the off-center opening 22 in the outer eccentric member 20, wherein the inner eccentic member 40 has an outer perimeter 41, an off-center opening 42 into which the aft support 120 of the gun 100 is free-fitted and is releasably supported and held, an inner perimeter 43 that is formed by the off-center opening 42; and, means, generally designated 50, for releasably locking, in a preselected rotational relationship, the inner eccentric member 40 to the outer eccentric member 20.

Additionally, the outer perimeter 21 of the outer eccentric member 20 has a scale 21A along it (i.e., the outer perimeter 21) that is divided into a plurality of a preselected number of marked equal spacings (i.e., stations), with each one of these spacings rotatably and selectively setable in alignment with the index marking 230 of the stationery support structure 200. Likewise, the outer perimeter 41 of the inner eccentric member 40 has a scale 41A along it (i.e., the outer perimeter 41A) that is divided into a plurality of a preselected number of marked spacings (i.e., stations).

Further, the opening 210 in the stationary support structure 200 is in the genetric form of a circle; the perimeter 220 formed by opening 210 is in the geometric form of a circumference of a circle; the outer perimeter 21 of the outer eccentric member 20 is in the geometric form of a circumference of a circle; the off-center opening 22 in the outer eccentric member 20 is in the geometric form of a circle; and, the outer perimeter 41 of the inner eccentric member 40 is in the geometric form of a circumference of a circle.

Also, as is readily apparent from the foregoing and from FIGS. 1–3, inclusive, outer eccentric member 20 is in the preferred geometric form of a cylinder, as is inner eccentric member 40.

It is to be noted that the aft support 120 of the gun 100 has an aft end 120A which is shaped cylinder-like. Accordingly, the inner perimeter 43 of the off-set opening 42 in the inner eccentric member 40 is in the geometric form of a circle that is complementary in size to the aft end 120A of the aft support 120 of the gun 100.

Still with reference to FIGS. 1–3, inclusive, the means 30 for releasably locking, in a preselected rotational relationship, the outer eccentric member 20 to the stationary support structure 200 includes: a groove 200A that is transversely positioned in the circumference 220 of the circular opening 210 in the stationary support structure, and simultaneously positioned adjacent to the index marking 230; a first plurality of identical grooves, such as 45A–45L, inclusive, FIGS. 2 and 3, one groove for each one of the plurality of marked spacings (i.e., stations) along the outer circumference 23 of the outer eccentric member 20, with these grooves transversely positioned in the outer circumference 23, and simultaneously positioned adjacent to a different one of the marked spacings, and with each groove of this plurality shaped complementary to the groove 200A in the circumference 220 of the circular opening 210 of the stationary support structure 200, so that an opening (such as 31) is formed by the stationary support structure groove 200A and by (or with) any groove selected from the first plurality of grooves (i.e., 45A–45L), when the one selected groove from this plurality is rotatably positioned adjacent to and abutting with the stationary support structure groove 200A; and, a first lock pin 32 that is shaped complementary to, and is removably inserted into, the opening (such as 31) that is formed by the stationary support structure groove 200A and by (or with) the adjacent, abutting, selected outer circumference groove (such as 45L, FIG. 2) of the outer eccentric member 40.

Still with reference to FIGS. 1–3, inclusive, the means 50 for releasably locking, in a preselected rotational relationship, the inner eccentric member 40 to the outer eccentric member 20 includes; a second plurality of identical grooves, such as A–E, inclusive, FIGS. 2 and 3, one of said grooves for each one of such plurality of marked spacings (i.e., stations) that are along the outer circumference 41 of the inner eccentric member 40, with these grooves transversely positioned in the outer circumference 42, and simultaneously positioned adjacent to a different one of the marked spacings; an index groove, such as 46A FIGS. 2 and 3, wherein said groove is shaped complementary to the identical grooves of the second plurality (i.e., A–D, FIGS. 2 and 3), and is transversely positioned at a preselected location in the inner circumference 23 of the off-center opening 22 in the outer eccentric member 20, so that an opening (such as 51, FIGS. 2 and 3) is formed by any one groove selected from the second plurality (such as A in FIG. 2, or E in FIG. 3) and the complementary index groove (such as 46A in both FIGS. 2 and 3), when the grooves (such as groove 46A and groove E in FIG. 3 which form opening 51); and, a second lock pin 52, FIGS. 1–3, inclusive, that is shaped complementary to, and is removably inserted into, the opening (such as 51) that is formed by the selected groove of the second plurality (such as E, FIG. 3) and by the adjacent, abutting, index groove (i.e., 46A, FIG. 3).

It is here to be noted that the GAAD further includes a retainer plate (such as 60, FIG. 1) that is disposed such as 60, FIG. 1) that is disposed in abutting contact with the inner eccentric member 40 and the outer eccentric member 20 simultaneously, with the retainer plate 60 secured to the outer eccentric member 20.

It is also to be noted, as a matter of preference and not of limitation, that the support structure groove 200A, and the index groove in the inner circumference of the outer eccentric member and each groove of the first and second, pluralities of grooves are identical to each other; that all grooves are each shaped in the geometric form of a semi-circle; that the first lock pin 32 and the second lock pin 52 are identical; and, that each lock pin 32 and 52 is shaped in the form of a right circular cylinder body with an external base and having a flanged head thereat (such as head 32A for pin 32, and head 52 A for pin 52, FIG. 1).

MANNER OF USE OF THE PREFERRED EMBODIMENT

As a preliminary matter, it is to be remembered that my GAAD 10, comprises essentially a cylindrical member (the outer eccentric 20) structured for controlled rotation within a fixed structure 200, and a second similar member (the inner eccentric 40) structured for controlled rotation within the first member (the outer eccentric 20). This provides a compact installation of light-weight, low-cost, simple components. Loads, such as the representative load shown in FIG. 1, are transmitted directly into the supporting structure 200 in short-bloc compression. The locking pins (or "keys"), such as 32 and 52, FIG. 1, which "fix" inner to outer eccentric, and outer eccentric to fixed structure, positively prevent all but intended changes to the GAAD adjustment. Torquing effort required to accomplish adjustment is only as required to overcome the rolling friction of the slip-fit assembly. The positive locking means eliminates need for maintenance between parts replacement intervals.

My GAAD is, in essence, a double-eccentric unit; and, it is a characteristic of a double-eccentric unit that, within its constricted structural range, it is capable of an infinite number of adjustments of its hub, such as 44, FIG. 1. However, to apply this characteristic to the attainment of quick, easy and positive adjustment of the gun alignment, such as 110, FIG. 1, a certain discipline is required. Therefore, the following is a preferred step-by-step method of setting or changing the alignment of a gun, such as 100, FIG. 1, which is in combination with my GAAD.

Figure 4:
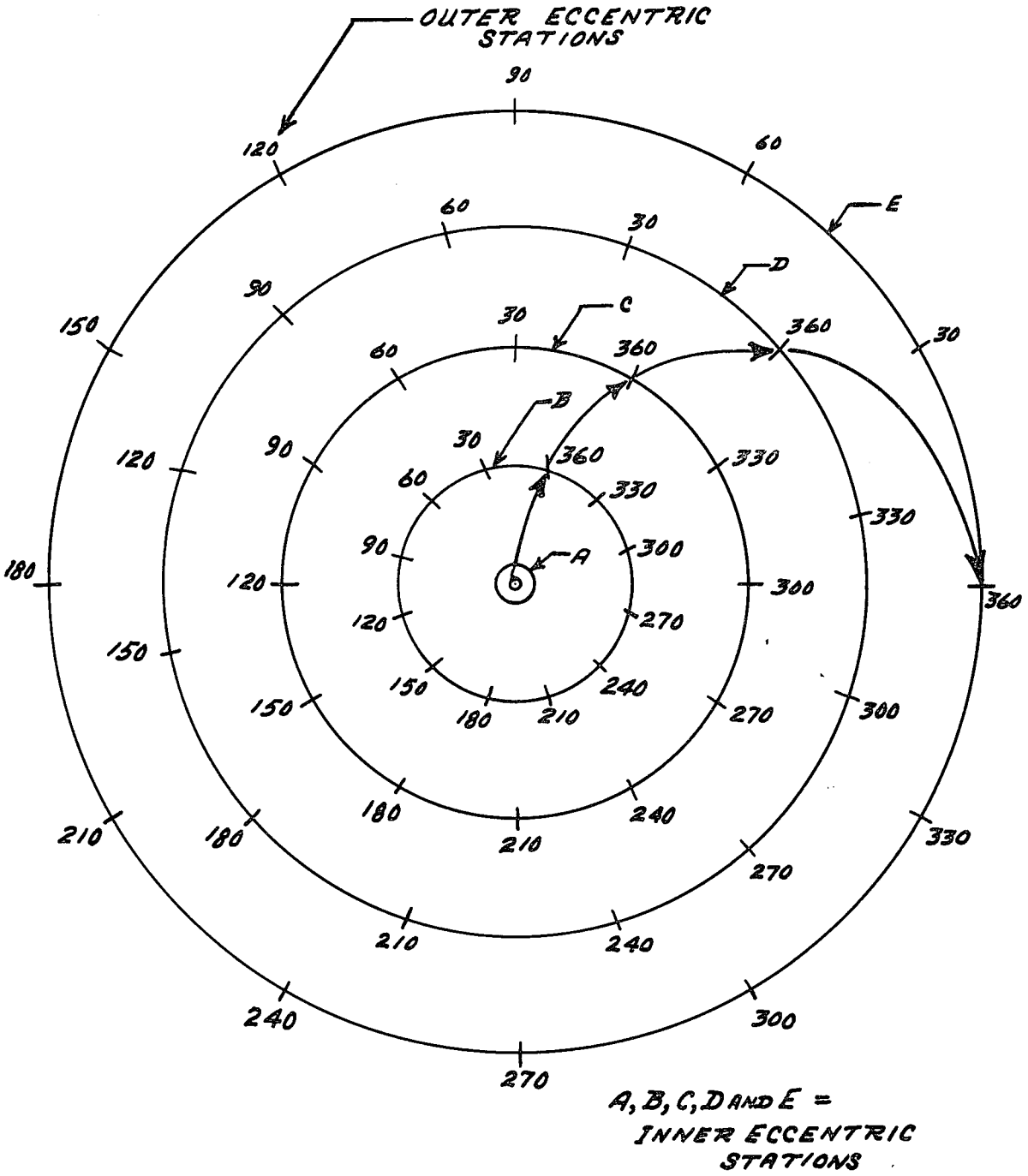
FIG. 4 is a diagram showing and identifying all station (i.e., setting) combinations of my GAAD; and, FIGS. 5–9, inclusive, are various views that will be described later herein, which illustrate the preferred step-by-step procedure in making a typical gun-line adjusting operation with the use of my inventive GAAD.

With reference generally to FIGS. 1–3, inclusive, and more specifically to FIGS. 4–9, inclusive:

Firstly, an appropriate diagram, such as FIG. 4, is drawn. In this regard, the number of stations between inner and outer eccentrics 40 and 20, and outer eccentric 20 and support structure 200, as determined by design requirement and/or physical restraints imposed by the locking system, is selected; and, each station is uniquely marked (in the diagram), with each combination of inner-to-outer eccentric stations thus representing a finite position of the gun support hub, such as 44, FIGS. 1 and 2, of the GAAD 10 and hence a definable attitude (i.e., alignment) of the gun 100, FIG. 1. The diagram, FIG. 4, is constructed to any convenient angle-, or mil-scale, showing and identifying all station combinations. Therefore, by construction, the diagram (FIG. 4) displays all available settings for the gun line, such as 110, FIG. 1, as each relates to the other.

Then, in use, after determining the direction and the degree of any required correction (i.e., correcting vector), from target observation or other, the setting, to which my GAAD 10 should be adjusted to make the indicated correction, is accomplished as follows (see FIGS. 5–9, inclusive):

At the diagram (i.e., FIG. 7, which is a duplicate reproduction of FIG. 4):

Firstly, note the station (i.e., C-30, FIG. 5) corresponding to the setting of my GAAD which produced the misaligned attitude of the gun 100 (i.e., FIG. 6).

Next, apply the correcting vector, as shown in FIG. 6, using the diagram scale (FIG. 7), and the original setting of my GAAD (i.e., C-30 FIG. 5) as the point that is the origin of the vector.

Then, observe and record on the diagram (FIG. 7) that station (i.e., D-180, FIG. 7) which most nearly coincides with the terminus of the correcting vector.

At the gun 100:

Reset the eccentrics to station corresponding to diagram station selected in previous step (i.e. D-180) as shown in FIG. 8.

The desired result is accomplished, as is shown in FIG. 9.

CONCLUSION

It is abundantly clear from all of the foregoing, and from the Figures of the drawings, that the stated desired principal object, as well as other related objects, of the invention have been achieved.

It is to be noted that, although there have been described and shown the fundamental and unique features of my invention as applied to a preferred embodiment, various other embodiments, variations, adaptations, substitutions, additions, omissions, and the like, may occur to, and can be made by, those of ordinary skill in the art, without departing from the spirit of my invention.

What is claimed is:

1. A gun alignment adjusting device, in combination with:

a. a gun having an alignment and an aft support;

b. and, a stationary support structure adjacent to and aft of said aft support of said gun, wherein said stationary support structure has an opening therein and therethrough in alignment with, and sized larger than, said aft support of said gun and has a perimeter formed by said opening, and also has an index marking at a preselected fixed location adjacent said opening and said perimeter thereof;

wherein said gun alignment adjusting device comprises:

a. an outer eccentric member rotatably mounted in said opening in said stationary support structure, wherein said outer eccentric member has an outer perimeter with a scale along thereat divided into a plurality of a preselected number of marked equal spacings, with each one of said marked spacings rotatably and selectively setable in alignment with said index marking of said stationary support structure, and wherein said outer eccentric member has an off-center opening therein and therethrough forming an inner perimeter of said outer eccentric member, with said off-center opening being sized larger than said aft support of said gun, and wherein said outer eccentric member also has an index marking at a preselected fixed location adjacent said off-center opening and said inner perimeter thereof;

b. means for releasably locking, in a preselected rotational relationship, sad outer eccentric member to said stationary support structure;

c. an inner eccentric member rotatably mounted in such off-center opening in said outer eccentric member, wherein said inner eccentric member has an outer perimeter with a scale along thereat divided into a plurality of a preselected number of marked spacings, an off-center opening therein and therethrough into which said aft support of said gun is free-fitted and is releasably supported and held, an inner perimeter formed by said off-center opening, and a hub portion surrounding said off-center opening;

d. and, means for releasably locking, in a preselected rotational relationship, said inner eccentric member to said outer eccentric member;

whereby said inner and outer eccentric members are rotatable and releasably lockable, in a preselected rotated positional relationship, relative to each other and to said stationary support structure, and whereby said inner and outer eccentric members are useable complementarily with, and cooperatively with, each other and with said stationary support structure, thereby permitting said alignment of said gun to be set, as desired.

2. A gun alignment adjusting device, as set forth in claim 1, wherein:

a. said opening in said stationary support structure is in the geometric form of a circle;

b. said perimeter formed by such opening in said stationary support structure is in the geometric form of a circumference of a circle;

c. said outer perimeter of said outer eccentric member is in the geometric form of a circumference of a circle;

d. said off-center opening in said outer eccentric member is in the geometric form of a circle;

e. and, said outer perimeter of said inner eccentric member is in the geometric form of a circumference of a circle.

3. A gun alignment adjusting device, as set forth in claim 2, wherein:

a. said outer eccentric member is in the geometric form of a cylinder;

b. and, said inner eccentric member is in the geometric form of a cylinder.

4. A gun alignment adjusting device, as set forth in claim 3, wherein said aft support of said gun has an aft end which is shaped cylinder-like, and wherein said inner perimeter formed by said off-set opening in said inner eccentric manner is in the geometric form of a circle complementary in size to said aft end of said aft support of said gun.

5. A gun alignment adjusting device, as set forth in claim 4, wherein said means for releasably locking, in a preselected rotational relationship, said outer eccentric member to said stationary support structure includes:

a. a groove, transversely positioned in said circumference of said circular opening of said stationary support structure and simultaneously positioned adjacent said index marking;

b. a first plurality of identical grooves, one of said grooves for each one of said plurality of marked spacings along said outer circumference of said outer eccentric member with said grooves transversely positioned in said outer circumference, and simultaneously positioned adjacent a different one of said marked spacings, wherein each groove of this plurality is shaped complementary to said groove in said circumference of said circular opening of said stationary support structure, whereby an opening is formed by said stationary support structure groove and by any groove selected from the plurality of outer circumference grooves by said outer eccentric number, when said selected outer circumference groove is rotatably positioned adjacent to and abutting with said stationary support structure groove;

c. and, a first lock pin shaped complementary to, and removably inserted into, said opening formed by said stationary support structure groove and by said adjacent, abutting, selected outer circumference groove by said outer eccentric member.

6. A gun alignment adjusting device, as set forth in claim 5, wherein said means for releasably locking, in a preselected rotational relationship, said inner eccentric member to said outer eccentric member includes:

a. a second plurality of identical grooves, one of said grooves for each one of said plurality of marked spacings along said outer circumference of said inner eccentric member, with said groove transversely positioned in said outer circumference, and simultaneously positioned adjacent a different one of said marked spacings;

b. an index groove shaped complementary to said identical grooves of said second plurality, with said groove transversely positioned at a preselected location in said inner circumference of said off-center opening in said outer eccentric member, whereby an opening is formed by any one groove selected from said second plurality and said complementary index when said selected groove of said second plurality is rotatably positioned adjacent to and abutting with said index groove;

c. and, a second lock pin shaped complementary to, and removably inserted into, said opening formed by said selected groove of said second plurality and by said adjacent, abutting, index groove.

7. A gun alignment adjusting device, as set forth in claim 6, wherein said means for releasably locking, in a preselected rotational relationship, said outer eccentric member to said stationary support structure, and said means for releasably locking, in a preselected rotational relationship, said inner eccentric member to said outer eccentric member, further include, in common, a retainer plate disposed in abutting contact with said inner and outer eccentric members simultaneously, wherein said retainer plate is secured to said outer eccentric member.

8. A gun alignment adjusting device, as set forth in claim 7, wherein said stationary support structure groove, said index groove of said outer eccentric member, and each groove of said first and second, pluralities of grooves are identical to each other, and are each shaped in the geometric form of a semi-circle, and wherein said first and second lock pins are identical, and are each shaped in the geometric form of a right circular cylinder body with an external base end having a flanged head thereat.

* * * * *